United States Patent [19]

McKinney et al.

[11] Patent Number: 4,594,286

[45] Date of Patent: Jun. 10, 1986

[54] COATED FABRIC

[75] Inventors: James M. McKinney, North Augusta; John G. Hodson, Graniteville, both of S.C.

[73] Assignee: Graniteville Company, Graniteville, S.C.

[21] Appl. No.: 731,315

[22] Filed: May 7, 1985

[51] Int. Cl.[4] ..... B32B 7/00

[52] U.S. Cl. ..... 428/245; 427/389.9; 427/393.3; 428/260; 428/265; 428/423.1; 428/913; 428/920; 428/252

[58] Field of Search ..... 427/389.9, 393.3; 428/245, 260, 913, 920, 265, 252, 423.1; 525/124

[56] References Cited

U.S. PATENT DOCUMENTS

| | | | |
|---|---|---|---|
| 3,085,027 | 4/1963 | Porteous | 428/248 |
| 4,454,191 | 6/1984 | Blücher et al. | 428/265 |

*Primary Examiner*—James J. Bell

*Attorney, Agent, or Firm*—Clifton Ted Hunt

[57] ABSTRACT

A flame retardant, water-proof fabric useful for tenting, tarpaulins and protective clothing comprises a woven substrate formed from synthetic fibers intimately coated with a homegeneous composition of binders, flame retardants and plasticizers. The composition includes a blocked polyester/polyether urethane prepolymer which, when cured at a temperature sufficient to unblock the urethane, provides strong film integrity to bond the coating to the substrate and thereby increase the effective life of the product.

40 Claims, No Drawings

COATED FABRIC

BACKGROUND OF THE INVENTION

It is known to provide lightweight coated fabrics of great strength which are flame resistant and resistant to mildew and ultra-violet degradation. All of these properties have been found to be desirable in a tent fabric intended for commercial or military use and are recited in Military Specification MIL-C-44103.

It is known in the prior art to provide fabrics meeting the requirements of Military Specification MIL-C-44103, dated June 27, 1983, for Cloth, Duck, Polyester, Fire, Water and Weather Resistant. A fabric meeting the requirements of Military Specification No. MIL-C-44103 has been manufactured by Graniteville Company of Graniteville, S.C. under its Product Code 990081 since Dec. 16, 1982. The Graniteville fabric is not patented, but is the closest prior art known to applicants. The Graniteville fabric has a polyester substrate, with a coating by impregnation of polyvinyl chloride polymer, chlorinated paraffin (40% Chlorine), chlorinated paraffin (70% Chlorine), 2-ethylhexyl diphenyl phosphate plasticizer, antimony trioxide, zinc oxide, decabromodiphenyl oxide, zirconium wax, epoxy resin, barium-cadmium, fumed silica and pigments.

It is also known in the prior art to provide a coated fabric which is resistant to abrasion. See U.S. Pat. No. 3,085,027, issued Apr. 9, 1963 upon application of John A. Porteous for POLYURETHANE COATED FABRIC FILLED WITH ISOCYANATE FREE ELASTOMER AND METHOD OF MAKING SAME.

The said Graniteville fabric meets the said military specification, but it has been found to lack the requisite film integrity to provide sufficient adhesion of the coating to the substrate and sufficient resistance to abrasion.

SUMMARY OF THE INVENTION

The fabric of the present invention utilizes all of the flame retardants contained in the prior art Graniteville fabric and supplements them with zinc borate, and with a thermosetting blocked polyester/polyether urethane prepolymer known for its properties of adhesion and abrasion resistance and which provides the flame retardant coating with film integrity which bonds the flame retardant coating to the substrate to an extent not heretofore known in the art of flame retardant fabrics. Adjustment of flame retardant ingredients and binders is considered an integral part of the present invention. The use of zinc borate in addition to the other flame retardants is desired for the improved product.

DETAILED DESCRIPTION OF THE INVENTION

The fabric of the present invention is structured to meet all of the practical needs of a tent fabric in all climates of the world. To accomplish this, the coating has been specially formulated to achieve film integrity which adheres the coating to the substrate, resists cracking at cold temperatures and resists abrasion at all temperatures. A plurality of flame retardants are included in the coating composition, each contributing to a flame retardant fabric which meets, or surpasses, the military specifications for tenting. The coating composition also includes plasticizers, binders, stabilizers and a thickening agent, and may include components to stabilize the coated fabric against heat and ultra-violet degradation, and may also include a mildew inhibitor. The composition thus far described is known to the prior art and, according to the invention, it is combined with a smaller amount of a thermosetting blocked polyester/polyether urethane prepolymer. The addition of zinc borate or barium metaborate to this composition is desired to meet performance requirements with the revised binder system. The revised binder system may include any polymeric binder such as polyvinyl chloride, polyvinyl acatate, chlorinated polyethylene, acrylic, and others. This composition is applied to the substrate and thereafter dried and cured at a sufficient temperature to unblock the thermosetting urethane, which tightly adheres the coating to the substrate.

The "blocked" urethane prepolymers which may be used in this composition may have in general either an ester and/or ether backbone. Typical ester materials are the esters prepared from ethylene glycol/polypropylene glycol/adipic acid mixtures. Castor oil may also be used. The useful prepolymers are formed by reacting the ester and/or ether materials with one or more organic diisocynate group containing materials such as toluene diisocyanate, diphenyl methane diisocyanate, 1,5-naphthalene diisocyanate, and hexamethylene diisocyanate so that the resulting product has an —NCO content of about 2.5 to at most about ten percent (10%) and, preferably, about three to four percent (3%-4%) by weight.

The "blocked" prepolymers are subsequently formed by reacting the isocyanate terminals with a monofunctional active hydrogen group. Typical blocking agents are ethylene imine, propylene imine, acetophenone oxime, butyraldoxime, methyl ethyl ketoxime and cychlohexanone oxime. The preferable blocking agent is methyl ethyl ketoxime. In the "blocked" form the material is non-reactive and stable for indefinite storage. Reactivity of the isocyanate terminals is restored by application of heat.

In the typical composition described on Pages 5 and 6 herein, we allow ambient moisture to effect the crosslinking following the "un-blocking" of the isocyanate terminals with heat. This allows the regenerated isocyanate terminals a greater opportunity to react with active hydrogen sites on the substrate and promote better adhesion.

It is also feasible to use cure agents to crosslink and/or chain-extend the urethane prepolymer after unblocking. Cure agents which are effective in the process of the present invention include N,N,N$^1$,N$^1$-tetrakis (2-hydroxypropyl) ethylene diamine, triisopropanolamine, triethanolamine, diethanolamine, diisopranolamine, phenyl diethanolamine, dichlorobenzidine, trimethylolpropane, (bis(p-aminocyclohexyl) methane), and methylene dianiline.

The cure agents are used in such quantities as to provide for ratios in equivalents of total isocyanate to that of reactive hydrogen values, which are furnished by the cure agents. The equivalents of active hydrogen of the cure agent in the form of OH or $HN_2$ groups to the equivalent of the prepolymer in terms of —NCO groups should be in a ratio of about 0.5 to 2.0 and preferably about 1.0.

Cure accelerators may also be used where it is desired to hasten the rate of cure and/or to reduce the temperature required to effect the cure. Cure accelerators which may be used include stannous octoate, lead octoate, 2,2,1-diazobicyclooctane, tetramethylbutane, diamine and dibutyltin di-2-ethylhexoate. Up to about two (2) parts by weight of the accelerators may be used per one hundred (100) parts by weight of blocked prepolymer. When cure accelerators are used, they are preferably added to the coating composition shortly before use to avoid the storage of accelerator with blocked prepolymer/cure system for prolonged periods.

The substrate of the fabric is preferably formed of essentially untwisted, continuous multi-filament yarns such as polyester or nylon that are free to flatten out in the fabric like miniature ribbons. These flat yarns have no more than the normal producers twist of one or two turns per inch. The flat yarns are woven into a fabric containing forty-four (44) warp yarns per inch and thirty-two (32) filling yarns per inch in a plain weave.

A typical general formulation for the coating of the present invention is as follows (without solvent carriers):

| COMPONENT | PERCENTAGE | FUNCTION |
|---|---|---|
| Polyvinyl Chloride Polymer | 9.47 | Flame Retardant Binder |
| "Blocked" Polyester/Polyurethane Polymer | 6.63 | Binder |
| Chlorinated Paraffin (40% Chlorine) | 5.26 | Flame Retardant Plasticizer |
| Chlorinated Paraffin (70% Chlorine) | 5.26 | Flame Retardant |
| 2-Ethylhexyl Diphenyl Phosphate | 8.42 | Flame Retardant Plasticizer |
| Antimony Trioxide | 22.36 | Flame Retardant |
| Zinc Oxide | 2.05 | Stabilizer & Mildew Inhibitor |
| Decabromodiphenyl Oxide | 15.79 | Flame Retardant |
| Zinc Borate | 15.79 | Flame Retardant |
| Fumed Silica | .63 | Thickening Agent |
| Zirconium Wax Complex | .50 | Water Repellant |
| Epoxy Resin | .05 | Stabilizer |
| Barium-Cadmium Complex | .30 | Stabilizer |
| Pigment System | 7.49 | Color/IR Properties |
| | 100.00 | |

The resulting coating has excellent film integrity and is preferably applied in a liquid state to the tightly woven substrate so as to penetrate the interstices of the substrate and be on both sides of the substrate. Satisfactory results have also been obtained substituting antimony pentoxide for antimony trioxide and substituting barium metaborate for zinc borate.

The processing temperature of 375° F. unblocks the urethane polymer and initiates cure and fusion of the entire coating composition on the tightly woven substrate. An essential element in achieving the desired adherence of the coating to the substrate is the filling of the interstices and of every surface of the woven substrate with the fire retardant composition and its cured urethane polymer. The unblocking and subsequent cross-linking of the urethane prepolymer during the curing of the coating locks the coating to the fibers to form a tough, strong, lightweight flame retardant fabric.

The woven substrate weights about eight (8) ounces per square yard. Average weight of the coated fabric for military tents is about thirteen (13) ounces per square yard but may be heavier if desired, as for tarpaulins. The coated fabric may be used for tents, tarpaulins, protective clothing and other purposes, as desired.

Although specific terms have been employed in describing the invention, they are used in a descriptive and generic sense only and not for purposes of limitation.

We claim:

1. A coated fabric which is tear resistant, abrasion resistant, water repellant and flame retardant formed of a substrate woven from yarns of synthetic fibers, a liquid coating containing flame retardant chemicals, a polymeric binder, and a thermosetting blocked urethane prepolymer applied to the woven substrate and cured by heat, whereby the thermoset coating is tightly adhered to the woven fabric.

2. A coated fabric according to claim 1 wherein the liquid coating includes zinc borate.

3. A coated fabric according to claim 2 wherein zinc borate is sixteen percent (16%) of the solids content of the coating.

4. A coated fabric according to claim 2 wherein selected flame retardant chemicals also function as plasticizers.

5. A coated fabric according to claim 4 wherein said selected chemicals include chlorinated paraffin (40% Chlorination) and 2-ethylhexyl diphenyl phosphate.

6. A coated fabric according to claim 1 wherein the liquid coating includes barium metaborate.

7. A coated fabric according to claim 6 wherein selected flame retardant chemicals also function as plasticizers.

8. A coated fabric according to claim 6 wherein said selected chemicals include chlorinated paraffin (40% Chlorination) and 2-ethylhexyl diphenyl phosphate.

9. A coated fabric according to claim 6 wherein the barium metaborate is at least fifteen percent (15%) of the solids content of the coating.

10. A coated fabric according to claim 1 wherein the binder is a mixture of polyvinyl chloride polymer and a blocked urethane polymer system.

11. A coated fabric according to claim 10 wherein the polyvinyl chloride polymer contributes to the flame retardant system.

12. A coated fabric according to claim 1 wherein the flame retardant chemicals comprise more than seventy percent (70%) of the coating.

13. A coated fabric according to claim 12 wherein the flame retardant chemicals include antimony trioxide, decabromodiphenyl oxide and zinc borate.

14. A coated fabric according to claim 13 wherein the antimony trioxide, decabromodiphenyl oxide and zinc borate comprise more than fifty percent (50%) of the coating.

15. A coated fabric according to claim 12 wherein the flame retardant chemicals include antimony pentoxide, decabromodiphenyl oxide and barium metaborate.

16. A coated fabric according to claim 15 wherein the antimony pentoxide, decabromodiphenyl oxide and barium metaborate comprise more than fifty percent (50%) of the coating.

17. A coated fabric according to claim 1 wherein the thermosetting blocked urethane is less than ten percent (10%) of the coating.

18. A coated fabric according to claim 17 wherein the thermosetting blocked urethane is a blocked polyester/-polyether urethane prepolymer.

19. A coated fabric according to claim 17 wherein the thermosetting blocked urethane is a blocked polyether urethane prepolymer.

20. A coated fabric according to claim 17 wherein the thermosetting blocked urethane is a blocked polyester urethane prepolymer.

21. A coated fabric according to claim 1 which weighs a maximum of thirteen and one-half (13.5) ounces per square yard.

22. A coated fabric according to claim 21 wherein the substrate weighs no more than eight (8) ounces per square yard.

23. A coated fabric according to claim 1 wherein the liquid coating includes a cure agent to cross-link and/or chain extend the urethane prepolymer after unblocking.

24. A coated fabric according to claim 23 wherein the cure agent is N,N,$N^1$,$N^1$-tetrakis (2-hydroxypropyl) ethylene diamine.

25. A coated fabric according to claim 23 wherein the cure agent is (bis(p-aminocychlohexyl)methane).

26. A coated fabric according to claim 1 wherein the urethane blocking agent is methyl ethyl ketoxime.

27. A coated fabric according to claim 1 wherein the synthetic fibers are essentially untwisted continuous polyester filaments.

28. A coated fabric according to claim 27 wherein the woven substrate contains at least forty-four (44) warp yarns per inch and thirty-two (32) filling yarns per inch.

29. A coated fabric according to claim 28 wherein the liquid coating is applied to all surfaces of the woven substrate.

30. A coated fabric according to claim 1 wherein the polymeric binder is polyvinyl chloride.

31. A coated fabric according to claim 1 wherein the polymeric binder is polyvinyl acetate.

32. A coated fabric according to claim 1 wherein the polymeric binder is chlorinated polyethylene.

33. A coated fabric according to claim 1 wherein the polymeric binder is acrylic.

34. A coated fabric formed of a substrate tightly woven from flat filaments, a liquid composition including flame retardants, a polymeric binder and a thermosetting blocked polyester/polyether urethane prepolymer applied to the substrate, and then cured by heat to unblock the urethane and adhere the thermoset coating to the substrate.

35. A coated fabric according to claim 34 wherein the polymeric binder is polyvinylchloride.

36. A method of making a coated fabric having tear resistance abrasion resistance, water repellance and flame retardance comprising the steps of:

(a) providing a substrate woven from synthetic fibers,
(b) providing a liquid composition including flame retardants, a polymeric binder and a thermosetting blocked urethane,
(c) applying the liquid composition to the substrate,
(d) drying the liquid composition on the substrate, and
(e) heat curing the coated substrate sufficiently to unblock the urethane and adhere the coating to the substrate.

37. A method according to claim 36 wherein the weight of the dried liquid composition is equal to at least fifty percent (50%) of the weight of the substrate per square yard.

38. A method according to claim 36 wherein the polymeric binder is polyvinylchloride.

39. A method for making a coated fabric having tear resistance and abrasion resistance and being water repellant and flame retardant, said method comprising (a) forming a liquid composition including
  (1) a blocked polyester/polyether urethane polymer and constituting less than ten percent (10%) of the dried liquid composition;
  (2) a polymeric binder constituting less than ten percent (10%) of the dried liquid composition;
  (3) flame retardant chemicals including antimony trioxide constituting between twenty (20%) and twenty-five percent (25%) of the dried liquid composition and decabromodiphenyl oxide comprising between fifteen (15%) and twenty percent (20%) of the dried liquid composition, and zinc borate comprising between fifteen (15%) and twenty percent (20%) of the dried liquid composition;
  (4) stabilizers including epoxy resin and barium-cadmium constituting less than one percent (1%) of the dried liquid composition;
  (5) a thickening agent comprising fumed silica constituting less than one percent (1%) of the dried liquid composition;
  (6) a water repellant comprising zirconium wax constituting less than one percent (1%) of the dried liquid composition;
(b) covering every surface of the substrate with the liquid composition;
(c) drying the liquid composition; and
(d) applying heat to the coated substrate for a period of time and at a temperature sufficient to unblock and cross-link the urethane polymer and fuse the coating on the substrate.

40. A method for making a coated fabric having tear resistance and abrasion resistance and being water repellant and flame retardant, said method comprising (a) forming a liquid composition including
  (1) a blocked polyester/polyether urethane polymer and constituting less than ten percent (10%) of the dried liquid composition;
  (2) a polymeric binder constituting less than ten percent (10%) of the dried liquid composition;
  (3) flame retardant chemicals including antimony pentoxide constituting between twenty (20%) and twenty-five percent (25%) of the dried liquid composition and decabromodiphenyl oxide comprising between fifteen (15%) and twenty percent (20%) of the dried liquid composition, and barium metaborate comprising between fifteen (15%) and twenty percent (20%) of the dried liquid composition;
  (4) stabilizers including epoxy resin and barium-cadmium constituting less than one percent (1%) of the dried liquid composition;
  (5) a thickening agent comprising fumed silica constituting less than one percent (1%) of the dried liquid composition;
  (6) a water repellant comprising zirconium wax constituting less than one percent (1%) of the dried liquid composition;
(b) covering every surface of the substrate with the liquid composition;
(c) drying the liquid composition; and
(d) applying heat to the coated substrate for a period of time and at a temperature sufficient to unblock and cross-link the urethane polymer and fuse the coating on the substrate.

* * * * *